US008074658B2

(12) United States Patent
Kittelsen et al.

(10) Patent No.: US 8,074,658 B2
(45) Date of Patent: Dec. 13, 2011

(54) COMPOSITE PERFORMANCE ENHANCING TETHERED MOUTHGUARD

(75) Inventors: Jon D. Kittelsen, Minneapolis, MN (US); Henry D. Cross, III, Murrell's Inlet, SC (US); Paul C. Belvedere, Edina, MN (US); Mark Herman, Minneapolis, MN (US)

(73) Assignee: Bite Tech, Inc., Minneapolis, MN (US)

( * ) Notice: Subject to any disclaimer, the term of this patent is extended or adjusted under 35 U.S.C. 154(b) by 0 days.

(21) Appl. No.: 10/460,886

(22) Filed: Jun. 12, 2003

(65) Prior Publication Data

US 2004/0250817 A1 Dec. 16, 2004

Related U.S. Application Data

(63) Continuation-in-part of application No. 09/657,421, filed on Sep. 8, 2000, now Pat. No. 6,626,180.

(51) Int. Cl.

| | |
|---|---|
| ***A61F 5/37*** | (2006.01) |
| ***A61F 5/56*** | (2006.01) |
| ***A61F 11/00*** | (2006.01) |
| ***A61C 5/14*** | (2006.01) |
| ***A61C 3/00*** | (2006.01) |
| *A42B 1/08* | (2006.01) |
| *A63B 71/10* | (2006.01) |

(52) U.S. Cl. ..... 128/861; 128/846; 128/848; 128/857; 128/859; 2/424; 2/425; 433/6

(58) Field of Classification Search ..... 128/859–862, 128/846, 848, 201.11, 204.26, 206.29, 857; 2/6.2, 424–425; 24/320, 350, 356, 96, 101 R, 24/174, 180, 707; 433/6

See application file for complete search history.

(56) References Cited

U.S. PATENT DOCUMENTS 257,038 A 4/1882 McMann (Continued)

FOREIGN PATENT DOCUMENTS

CA 1147583 6/1983

OTHER PUBLICATIONS

Mouth Protectors: Give Your Teeth a Sporting Chance, American Dental Association, 1985.

(Continued)

*Primary Examiner* — Michael Brown
*Assistant Examiner* — Brandon Jackson
(74) *Attorney, Agent, or Firm* — Clise, Billion & Cyr, PA; Ben Armitage

(57) ABSTRACT

A performance enhancing and force absorbing mouthguard adapted to fit the upper teeth of the mouth of an athlete wherein the mouthguard is unobstructably tethered and of a composite material. The first internal layer is a nonsoftenable flexible framework which will permit the mouthguard to hold its shape during fitting as well as to absorb and dissipate significant impact conveyed to the upper teeth. A hard, durable bite plate wedge lowers the condyle from the temporomandibular joint in a fulcrum action to place the lower jaw in an optimum condition preventing impingement upon the nerves and arteries as well as spacing the upper and lower teeth apart. Elastomeric traction pads are on the bottom of the mouthguard and are grippingly engaged by the posterior teeth of the lower jaw. While the framework, wedge and traction pads are mechanically interlocked, a softenable material is placed over the mouthguard excepting the contact portions of the traction pads to encapsulate the mouthguard and to permit custom fitting. An anterior tab supports a transverse external bumper having left and right ports to unobstructively tether the mouthguard.

27 Claims, 5 Drawing Sheets

U.S. PATENT DOCUMENTS

| | | | | |
|---|---|---|---|---|
| 1,117,928 | A | | 11/1914 | Thurmond |
| 1,323,832 | A | | 12/1919 | Chige |
| 1,461,209 | A | | 7/1923 | Bridges |
| 1,470,888 | A | | 10/1923 | Smedley |
| 1,487,392 | A | | 3/1924 | Lee |
| 2,118,980 | A | | 5/1938 | Montgomery et al. |
| 2,257,709 | A | | 9/1941 | Anderson |
| 2,423,005 | A | | 6/1947 | Chaiken |
| 2,630,117 | A | | 3/1953 | Coleman |
| 2,643,652 | A | | 6/1953 | Cathcart |
| 2,659,366 | A | | 11/1953 | Savarese |
| 2,669,988 | A | | 2/1954 | Carpenter |
| 2,678,043 | A | | 5/1954 | Stark |
| 2,694,397 | A | | 11/1954 | Herms |
| 2,702,032 | A | | 2/1955 | Freedland |
| 2,708,931 | A | | 5/1955 | Freedland |
| 2,750,941 | A | | 6/1956 | Cathcart |
| 2,833,278 | A | | 5/1958 | Ross |
| 2,847,003 | A | | 8/1958 | Helmer et al. |
| 2,933,811 | A | | 4/1960 | Lifton |
| 2,966,908 | A | | 1/1961 | Cathcart et al. |
| 3,016,052 | A | | 1/1962 | Zubren |
| 3,058,462 | A | | 10/1962 | Greenblum |
| 3,073,300 | A | | 1/1963 | Berghash |
| 3,082,765 | A | | 3/1963 | Helmer |
| 3,107,667 | A | | 10/1963 | Moore |
| 3,124,129 | A | | 3/1964 | Grossberg |
| 3,126,002 | A | | 3/1964 | Owens |
| 3,203,417 | A | | 8/1965 | Helmer |
| 3,207,153 | A | | 9/1965 | Goldstein |
| 3,223,085 | A | | 12/1965 | Gores et al. |
| 3,247,844 | A | | 4/1966 | Berghash |
| 3,312,218 | A | | 4/1967 | Jacobs |
| 3,319,626 | A | | 5/1967 | Lindsay |
| 3,407,809 | A | | 10/1968 | Ross |
| 3,411,501 | A | | 11/1968 | Greenberg |
| 3,416,527 | A | | 12/1968 | Hoef |
| 3,448,738 | A | | 6/1969 | Berghash |
| 3,457,916 | A | | 7/1969 | Wolicki |
| 3,485,242 | A | | 12/1969 | Greenberg |
| 3,496,936 | A | | 2/1970 | Gores |
| 3,505,995 | A | | 4/1970 | Greenberg |
| 3,513,838 | A | | 5/1970 | Foderick et al. |
| 3,518,988 | A | | 7/1970 | Gores |
| 3,532,091 | A | | 10/1970 | Lerman |
| 3,682,164 | A | * | 8/1972 | Miller ..... 128/857 |
| 3,692,025 | A | | 9/1972 | Greenberg |
| D228,048 | S | * | 8/1973 | Miller ..... D29/108 |
| 3,768,465 | A | | 10/1973 | Helmer |
| 3,864,832 | A | | 2/1975 | Carlson |
| 3,916,527 | A | | 11/1975 | Linkow |
| 3,924,638 | A | | 12/1975 | Mann |
| 3,943,924 | A | | 3/1976 | Kallestad et al. |
| 4,030,493 | A | | 6/1977 | Walters et al. |
| 4,044,762 | A | | 8/1977 | Jacobs |
| 4,063,552 | A | | 12/1977 | Going et al. |
| 4,114,614 | A | | 9/1978 | Kesling |
| 4,185,817 | A | | 1/1980 | Peterson |
| 4,211,008 | A | | 7/1980 | Lerman |
| 4,330,272 | A | | 5/1982 | Bergersen |
| 4,337,765 | A | | 7/1982 | Zimmerman |
| 4,348,178 | A | | 9/1982 | Kurz |
| 4,376,628 | A | | 3/1983 | Aardse |
| 4,457,708 | A | | 7/1984 | Dufour |
| 4,490,112 | A | | 12/1984 | Tanaka et al. |
| 4,495,945 | A | | 1/1985 | Liegner |
| 4,519,386 | A | | 5/1985 | Sullivan |
| 4,568,280 | A | | 2/1986 | Ahlin |
| 4,591,341 | A | | 5/1986 | Andrews |
| 4,640,273 | A | | 2/1987 | Greene et al. |
| 4,651,356 | A | * | 3/1987 | Zide ..... 2/421 |
| 4,671,766 | A | | 6/1987 | Norton |
| 4,672,959 | A | | 6/1987 | May et al. |
| 4,727,867 | A | | 3/1988 | Knoderer |
| 4,755,139 | A | | 7/1988 | Abbatte et al. |
| 4,763,791 | A | | 8/1988 | Halverson et al. |
| 4,765,324 | A | | 8/1988 | Lake, Jr. |
| 4,791,941 | A | | 12/1988 | Schaefer |
| 4,793,803 | A | | 12/1988 | Martz |
| 4,799,500 | A | | 1/1989 | Newbury |
| 4,810,192 | A | | 3/1989 | Williams |
| 4,838,283 | A | | 6/1989 | Lee, Jr. |
| 4,848,365 | A | | 7/1989 | Guarlotti et al. |
| 4,867,147 | A | | 9/1989 | Davis |
| 4,920,984 | A | | 5/1990 | Furumichi et al. |
| 4,944,947 | A | | 7/1990 | Newman |
| 4,955,393 | A | | 9/1990 | Adell |
| 4,976,618 | A | | 12/1990 | Anderson |
| 4,977,905 | A | | 12/1990 | Kittelsen et al. |
| 4,989,616 | A | | 2/1991 | Lee, Jr. |
| 5,031,611 | A | | 7/1991 | Moles |
| 5,031,638 | A | | 7/1991 | Castaldi |
| 5,063,940 | A | | 11/1991 | Adell et al. |
| 5,076,785 | A | | 12/1991 | Tsai |
| 5,082,007 | A | | 1/1992 | Adell |
| 5,103,838 | A | | 4/1992 | Yousif |
| 5,112,225 | A | | 5/1992 | Diesso |
| 5,117,816 | A | | 6/1992 | Shapiro et al. |
| D328,494 | S | | 8/1992 | Schwendeman et al. |
| 5,152,301 | A | | 10/1992 | Kittelsen et al. |
| 5,154,609 | A | | 10/1992 | George |
| 5,165,424 | A | | 11/1992 | Silverman |
| 5,174,284 | A | | 12/1992 | Jackson |
| 5,194,003 | A | | 3/1993 | Garay et al. |
| 5,194,004 | A | | 3/1993 | Bergersen |
| 5,203,351 | A | | 4/1993 | Adell |
| 5,234,005 | A | | 8/1993 | Kittelsen et al. |
| 5,235,991 | A | | 8/1993 | Minneman |
| 5,259,762 | A | | 11/1993 | Farrell |
| 5,277,203 | A | | 1/1994 | Hays |
| D343,928 | S | | 2/1994 | Kittelsen |
| 5,293,880 | A | | 3/1994 | Levitt |
| 5,297,960 | A | | 3/1994 | Burns |
| 5,299,936 | A | | 4/1994 | Ueno |
| 5,302,117 | A | | 4/1994 | Kraut et al. |
| 5,313,960 | A | | 5/1994 | Tosasi |
| 5,316,474 | A | | 5/1994 | Robertson |
| 5,320,114 | A | | 6/1994 | Kittelsen et al. |
| 5,323,787 | A | | 6/1994 | Pratt |
| 5,328,362 | A | | 7/1994 | Watson et al. |
| 5,336,086 | A | | 8/1994 | Simmen |
| 5,339,832 | A | | 8/1994 | Kittelsen et al. |
| 5,353,810 | A | | 10/1994 | Kittelsen et al. |
| 5,365,946 | A | | 11/1994 | McMillan |
| 5,385,155 | A | | 1/1995 | Kittelsen et al. |
| 5,386,821 | A | | 2/1995 | Poterack |
| D356,188 | S | | 3/1995 | Kittelsen |
| 5,401,234 | A | | 3/1995 | Libin |
| 5,406,963 | A | | 4/1995 | Adell |
| 5,447,168 | A | | 9/1995 | Bancroft |
| 5,460,527 | A | | 10/1995 | Kittelsen |
| 5,469,865 | A | | 11/1995 | Minneman |
| 5,490,520 | A | | 2/1996 | Schaefer et al. |
| 5,511,562 | A | | 4/1996 | Hancock |
| 5,513,656 | A | | 5/1996 | Boyd, Sr. |
| 5,533,524 | A | | 7/1996 | Minneman |
| D373,421 | S | | 9/1996 | Brown |
| 5,566,684 | A | | 10/1996 | Wagner |
| 5,584,687 | A | | 12/1996 | Sullivan |
| 5,586,562 | A | | 12/1996 | Matz |
| 5,590,643 | A | | 1/1997 | Flam |
| 5,592,951 | A | | 1/1997 | Castagnaro |
| 5,624,257 | A | | 4/1997 | Farrell |
| 5,636,379 | A | | 6/1997 | Williams |
| 5,646,216 | A | | 7/1997 | Watson et al. |
| 5,649,534 | A | | 7/1997 | Briggs, III |
| 5,666,973 | A | | 9/1997 | Walter |
| 5,692,523 | A | | 12/1997 | Croll et al. |
| 5,718,243 | A | | 2/1998 | Weatherford et al. |
| 5,718,575 | A | | 2/1998 | Cross, III |
| 5,730,599 | A | | 3/1998 | Pak |
| 5,746,221 | A | | 5/1998 | Jones et al. |
| D397,442 | S | | 8/1998 | Kittelsen |
| 5,810,013 | A | * | 9/1998 | Belfer ..... 128/848 |
| 5,816,255 | A | | 10/1998 | Fishman et al. |
| 5,819,744 | A | | 10/1998 | Stoyka, Jr. |
| 5,823,193 | A | | 10/1998 | Singer et al. |

| | | | | |
|---|---|---|---|---|
| 5,823,194 | A | 10/1998 | Lampert | |
| 5,826,581 | A | 10/1998 | Yoshida | |
| 5,836,761 | A | 11/1998 | Belvedere et al. | |
| 5,865,619 | A | 2/1999 | Cross, III et al. | |
| 5,873,365 | A | 2/1999 | Brown | |
| 5,879,155 | A | 3/1999 | Kittelsen | |
| 5,915,385 | A | 6/1999 | Hakimi | |
| 5,921,240 | A | 7/1999 | Gall | |
| 5,921,241 | A * | 7/1999 | Belfer | 128/848 |
| 5,931,164 | A | 8/1999 | Kiely et al. | |
| 5,947,918 | A | 9/1999 | Jones et al. | |
| 5,970,981 | A | 10/1999 | Ochel | |
| 6,012,919 | A | 1/2000 | Cross, III et al. | |
| 6,036,487 | A | 3/2000 | Westerman | |
| 6,039,046 | A | 3/2000 | Swartz et al. | |
| 6,068,475 | A | 5/2000 | Stoyka, Jr. | |
| 6,082,363 | A | 7/2000 | Washburn | |
| 6,092,524 | A | 7/2000 | Barnes, Sr. | |
| 6,098,627 | A | 8/2000 | Kellner et al. | |
| 6,109,266 | A | 8/2000 | Turchetti | |
| 6,152,138 | A | 11/2000 | Brown et al. | |
| 6,257,239 | B1 * | 7/2001 | Kittelsen et al. | 128/859 |
| 6,321,752 | B1 * | 11/2001 | Spottiswoode | 128/859 |
| 6,423,049 | B1 * | 7/2002 | Tominaga et al. | 604/392 |
| 6,494,210 | B1 * | 12/2002 | Mams | 128/859 |
| 6,553,996 | B2 | 4/2003 | Kittelsen et al. | |

OTHER PUBLICATIONS

Stephen D. Smith, D.M.D., Muscular Stength Correlated to Jaw Posture and the Temporomandibular Joint, New York State Dental Journal, vol. 44, No. 7, Aug.-Sep. 1978.

W.B. May, D.D.S., Reduction of Stress in the Chewing Mechanism—Part III.

* cited by examiner

COMPOSITE PERFORMANCE ENHANCING TETHERED MOUTHGUARD

CROSS-REFERENCE TO RELATED APPLICATIONS

The present U.S. Patent Application is a continuation-in-part of U.S. patent application Ser. No. 09/657,421, filed Sep. 8, 2000, now issued as U.S. Pat. No. 6,626,180.

BACKGROUND OF THE INVENTION

This invention generally relates to a performance enhancing and force absorbing composite mouthguard for use by athletes, and more particularly to such an adjustable customizable tethered mouthguard appliance that spaces apart the teeth to absorb shock and clenching stress to protect the anterior and posterior teeth of the upper jaw, to lessen condyle pressure, force and impact upon the cartlidge and temporomandibular joints, the arteries and the nerves and to further increase body muscular strength and endurance.

A number of mouthguards currently exist in the art for protecting the teeth and for reducing the chance of shock, concussions and other injuries as a result of high impact collisions and blows during athletic competition. Mouthguards generally are characterized as being non-personalized, universal and stock model type, or are formed to have direct upper jaw tooth-formed contact. These are customizable mouthguards.

Additionally, the mouthguards may be tethered or untethered. Mouthguards may be tethered to a fastening point, such as a helmet or face guard, to prevent the chance of the mouthguard from being lost as well as to prevent swallowing of the mouthguard or choking on the mouthguard by the user. However, tethers should be releasable in case the helmet is dislodged from the head to avoid further injury. Most tethers are cumbersome and are a visual obstruction in front of the face of the wearer.

The lack of a mouthguard or the use of an improperly fitted mouthguard, when impacts, collisions or blows occur to the jaw structure of an athlete, have recently been found to be responsible for illnesses or injuries. Such injured athletes are susceptible to headaches, presence of earaches, ringing in the ears, clogged ears, vertigo, concussions and dizziness. The cause of these types of health problems and injuries are generally not visible by inspection of the mouth or the jaw but more particularly relate to the temporomandibular joint (TMJ) and surrounded tissues where the lower jaw is connected to the skull in the proximity where the auriculotemporalis nerves and supra-temporo arteries pass from the neck into the skull to the brain.

In addition to protection of the teeth and the TMJ, athletes clench their teeth during exertion which results in hundreds of pounds of compressed force exerted from the lower jaw onto the upper jaw. Such clenching can result in headaches, muscle spasms, damage to teeth, injury to the TMJ and pain in the jaw. Furthermore, clenching of the teeth makes breathing more difficult during physical exercise and endurance when breathing is most important.

Most importantly, many problems exist with prior mouthguards. Mouthguards with rigid labial or buccal walls do accept wide teeth, were bulky and had sharp edges. When the custom appliances were placed in hot water to soften for fitting, the mouthguards tended to collapse and permit portions to touch and stick together upon removal from the hot water thus making fitting of such mouthguards always a problem. Delamination and chewing destruction caused short life of the mouthguards.

There is a need for a mouthguard that solves all of the problems disclosed and will further achieve improved performance and long life as well as being easy to fit and wear for the athlete.

SUMMARY OF THE INVENTION

A performance enhancing and force absorbing mouthguard adapted to fit the upper teeth of the mouth of an athlete wherein the mouthguard is unobstructably tethered and of a composite material. The first internal layer is a nonsoftenable flexible framework which will permit the mouthguard to hold its shape during fitting as well as to absorb and dissipate significant impact conveyed to the upper teeth. A hard, durable bite plate wedge lowers the condyle from the temporomandibular joint in a fulcrum action to place the lower jaw in an optimum condition preventing impingement upon the nerves and arteries as well as spacing the upper and lower teeth apart. Elastomeric traction pads are on the bottom of the mouthguard and are grippingly engaged by the posterior teeth of the lower jaw. While the framework, wedge and traction pads are mechanically interlocked, a softenable material is placed over the mouthguard excepting the contact portions of the traction pads to encapsulate the mouthguard and to permit custom fitting. An anterior tab supports a transverse external bumper having left and right ports to unobstructively tether the mouthguard.

The principle object and advantage of the present invention is that the mouthguard is that it protects the teeth, jaw, gums, connective tissues, back, head and muscles from concussive impact or blows to the jaw or teeth typically occurring during athletic activity.

Another object and advantage of the present invention is that the materials are substantially mechanically interlocked as well as encapsulated thereby preventing the possibility of delamination or separation of the materials which otherwise may occur during chewing of the mouthguard by the wearer.

Another object and advantage of the present invention is that the mouthguard places the lower jaw in the power position moving the condyle downwardly and forwardly away from the nerves and arteries within the fossia or socket to raise body muscular strength, greater endurance, improved performance by the mouthguard user as well as offer protection against concussive impacts.

Another object and advantage of the present invention is that the mouthguard is customizable to fit the width and configurations of the upper posterior teeth and palate structure of any user. That is, the mouthguard permits customizable fitting, including twisting, contraction and expansion, to permit the various tooth widths, spacing from one side of the mouth to the other side of the mouth, and palate height which also vary substantially from person to person.

Another object and advantage of the present invention is that it has a tough, rubbery elastomeric, unpenetrable bottom layer or traction pad which engages and grips the posterior teeth of the lower jaw and which further prevents the appliance from being chewed through to thereby assure long life to the appliance.

Another object and advantage of the present invention is that the framework of a non-softenable flexible material supports the appliance after heating to maintain shape and to guide the upper teeth during the fitting process.

Another object and advantage of the present invention is that the hard durable bite plate wedge is of a hard very durable material that acts as a bite plate wedge or fulcrum that cannot the be penetrated by teeth thereby giving the appliance a longer life cycle.

Another object and advantage of the present invention is that the labial and lingual walls are not rigid allowing the user to manipulate the softenable material and to custom fabricate the mouthguard to accommodate proper fitting and to achieve more comfortable and less intrusive presence in the wearers mouth.

Another object and advantage of the present invention is that an anti-microbial ingredient keeps the appliance free of germs, fungus, virus, yeast and bacteria and also may treat gum disease.

Another object and advantage of the present invention is an internal protective elastomeric bumper extending anteriorly from the traction pads for protecting the anterior teeth.

Another object and advantage of the present invention is the external protective elastomeric bumper which protects the mouth.

Another object and advantage of the present invention is the left and right tether anchor ports which unobstructively permit tethering the mouthguard from either the left or right side according to wearer preference as mouthguards are often removed and reinserted during athletic activity.

Another object and advantage of the present invention is that the external bumper is suitable for bearing an artistic logo.

Another object and advantage of the present invention is that the logo, tether or remote anchor may be illuminated.

Another object and advantage of the present invention is that the tethered mouthguard may be remotely anchored in a variety of ways.

DETAILED DESCRIPTION OF THE PREFERRED EMBODIMENT

Figure 1:
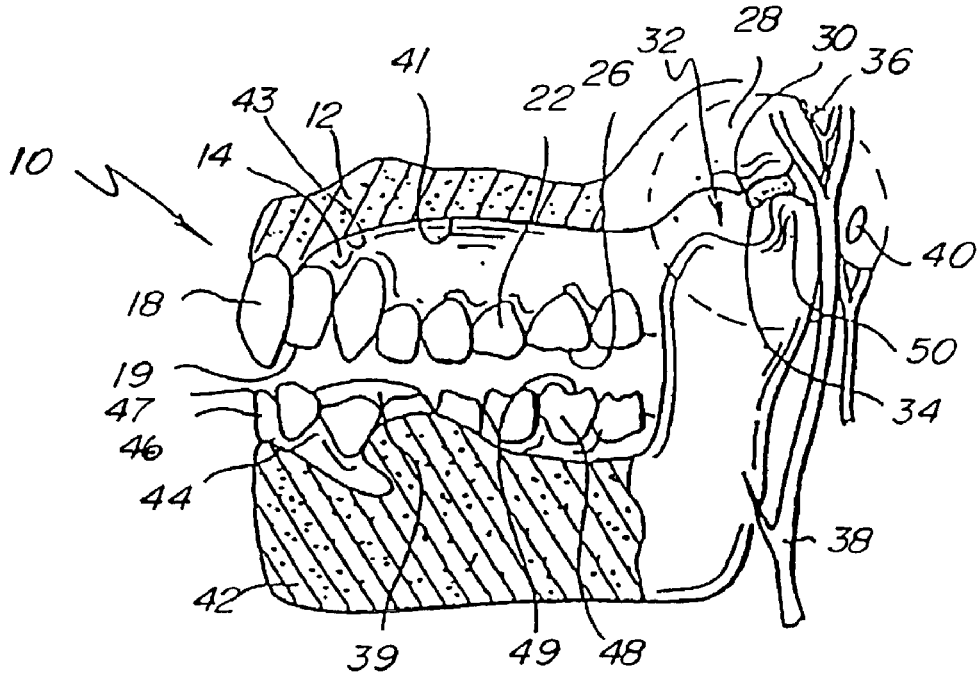
FIG. 1 is a maxillary mandibular buccal or partial side elevational view of the jaws and temporomandibular joint of the user of the mouthguard of the present invention.
Figure 1A:
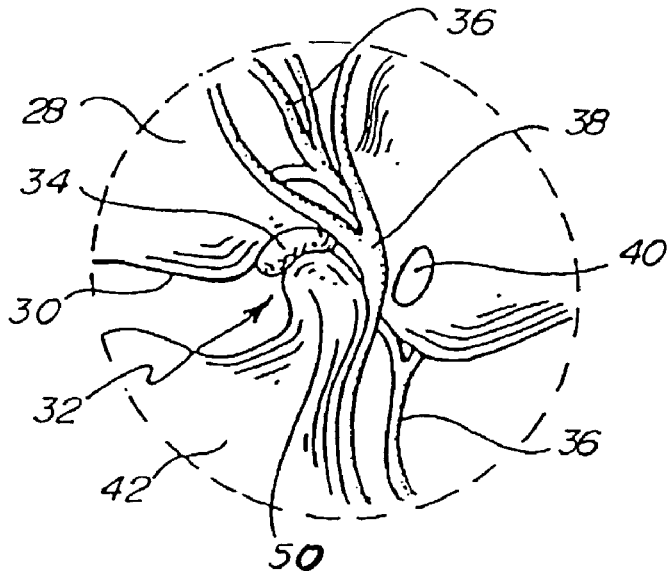
FIG. 1A is an enlarged view of the temporomandibular joint portion of FIG. 1.

To understand the structural features and benefits of the dental appliance or mouthguard 70 of the present invention, some anatomy will first be described. Referring to FIGS. 1 and 1A, the user or athlete has a mouth 10 generally comprised of a rigid upper jaw 12 and a movable lower jaw 42 which are movably connected at the temporomandibular joint (TMJ) 32 and 50.

More specifically, the rigid upper jaw 12 has gum tissue 14 within mouth 10. Gum tissue 14, as well as the bone thereunder, supports anterior teeth (incisors and canines) 18 which have incisal or biting surfaces 19. The gum tissues 14 and the bone thereunder also support posterior teeth (molars and bicuspids) 22 which have cusps or biting surfaces 26.

Referring to one side of the human head, the temporal bone 28 is located upwardly and rearwardly of the upper jaw 12 and is in the range of $1/16^{th}$ to $1/32^{nd}$ inch thick. The articular eminence 30 forms the beginning of the fossae 32 or the socket of the temporomandibular joint 32 and 50.

Rearwardly and posteriorly to the articular eminence 30 is located cartilage 34. Through the temporomandibular joint 32 and 50 pass the ariculo-temporalis nerve 36 and supra-temporo artery 38. Posteriorly to this structure is located the inner ear 40. Within the mouth is located tongue 39 and the roof or hard palate 41, which terminates rearwardly into the soft palate and forwardly into the anterior palate or ruggae 43. The ruggae 43 has a rib surface which is identifiable by the fingers or tongue 39. The tongue touches the ruggae 43 during speech.

The movable jaw or mandible 42 supports a bone covered by gum tissue 44 which further supports anterior teeth (incisors and canines) 46 with incisal or biting surfaces 47 and posterior teeth (molars and bicuspids) 48 with occlusal biting surfaces 49. The condyle 50 of the lower jaw 42 forms the ball of the temporormandibular joint 32 and 50. The anatomical structure is the same for both sides of the head.

Repeated impacts, collisions, blows, stress or forces exerted on the movable lower jaw 42 results in excessive wearing forced upon the condyle 50 and the cartilage, meniscus, or disc 34—typically resulting in bone deterioration on the head of the condyle or slippage and compressive damage of the cartilage 34. Thereafter, the lower jaw 42 may be subject to irregular movement, pain, loss of comfortable range of movement, and clicking of the joint 32 and 50.

The ariculo-temporatis nerve 36 relates to both sensory and motor activity of the body. Any impingement or pinching of this nerve 36 can result in health problems as previously mentioned. This supra-temporal artery 38 is important in that it provides blood circulation to portions of the head. Impingement, pinching, rupture or blockage of this artery 38 will result in possible loss of consciousness and reduced physical ability and endurance due to the restriction of blood flow to portions of the brain. Thus, it is extremely important to assure that the condyle 50 does not impinge upon the ariculo-temporalis nerve 36 or the supra-temporal artery 38. It is also important to note that the temporal bone 28 is not too thick in the area of the glenoid fossae. Medical science has shown that a sharp shock, stress or concussive force applied to the lower jaw 42 possibly could result in the condyle 50 pertruding through the glenoid fossae of the temporal bone 28 thereby causing death. This is a suture line (growth and development seam) in the glenoid fossae, resulting in a possible weakness in the fossae in many humans. This incident rarely, but sometimes, occurs with respect to boxing athletes.

The mouthguard of the present invention is shown in the Figures as reference number 70.

Mouthguard 70 is generally u-shaped and is comprised of labial wall 72, lingual wall 74, which are upstanding from base 76, and channel 78 is formed by this arrangement.

Figure 2:
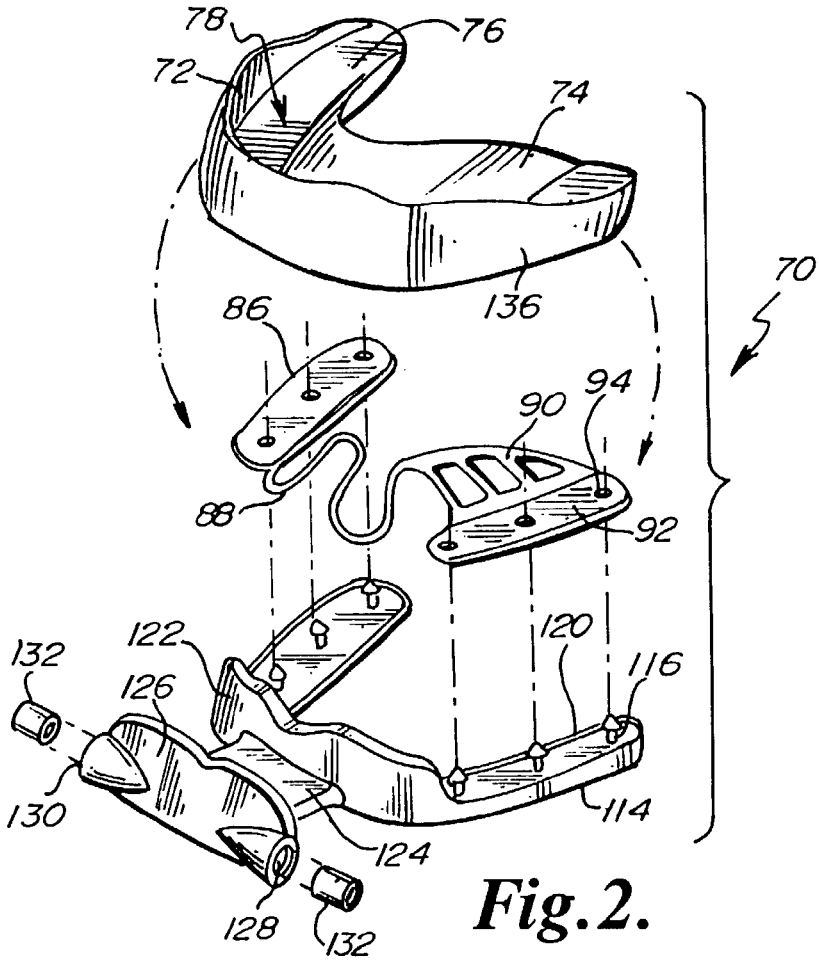
FIG. 2 is an exploded view of the composite tethered mouthguard.
Figure 3:
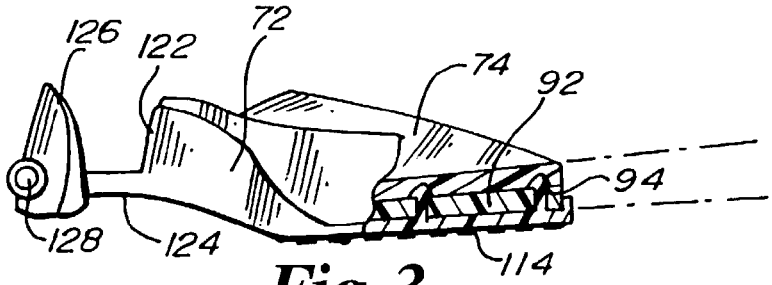
FIG. 3 is a side elevational view partially broken away of the mouthguard showing the wedge being thicker posteriorly than anteriorly.
Figure 4:
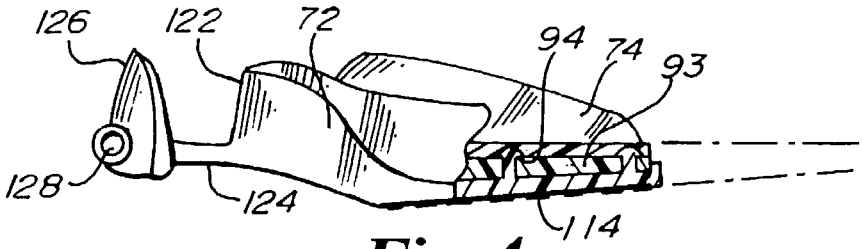
FIG. 4 is a side elevational view partially broken away similar to FIG. 3 with the wedge being thicker anteriorly than posteriorly.
Figure 5:
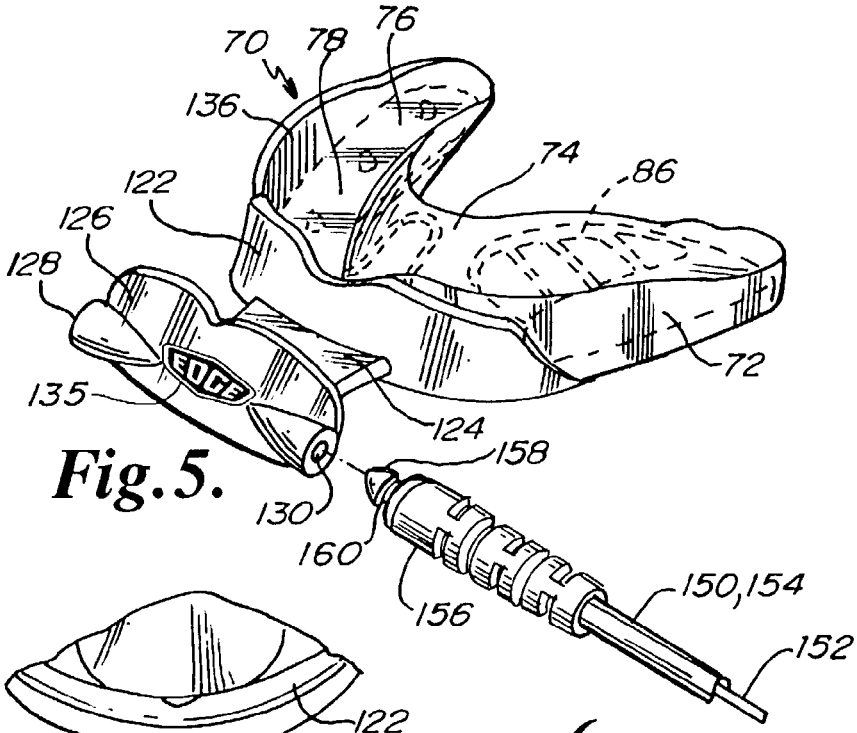
FIG. 5 is a perspective view of the mouthguard bearing a logo with the tether about to be inserted into the left port.
Figure 6:
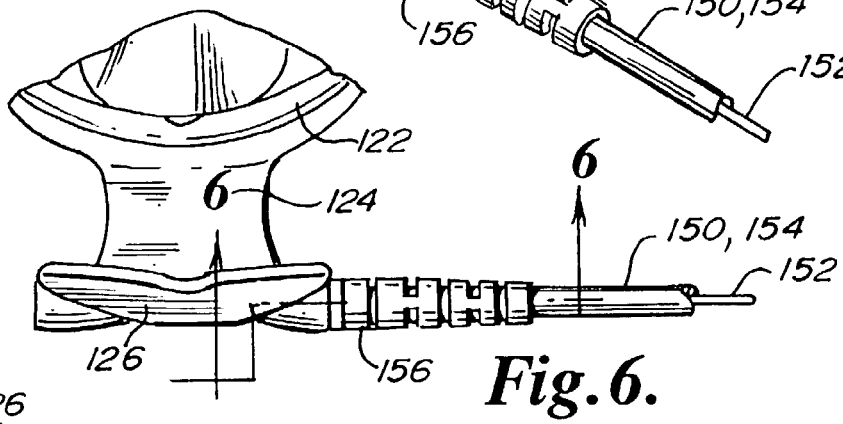
FIG. 6 is a top plan view of the mouthguard and tether connected partially broken away.

Specifically referring to FIGS. 2-4, the mouthguard 70 generally comprises three layers of distinct materials 86, 114 and 136. The framework 86 is of a non-softenable, flexible material to assist in maintaining the shape of the heated mouthguard 70 and to permit the sizing of the mouthguard by way of twisting, expansion and contraction for variously configured mouths. The bite plate wedge 92 is part of the framework and permits displacement of the condyle and proper positioning of the lower jaw 42. The traction pads 114 are elastomeric and therefore rubbery and grippable. The anterior impact brace or internal protective bumper 122 extends from the traction pads 114 while the external protective bumper 126 extends from the internal protective bumper 122. The encapsulating material 136 is softenable and forms walls 72 and 74 and channel 78. This portion of the mouthguard 70 softens when heated and permits custom fitting of the mouthguard 70 in a particular mouth configuration.

The first shot of the mouthguard 70 is comprised of the non-softenable, flexible framework 86 which is suitably made of high-density polyethylene which exhibits a rigid character in that it holds its shape and can handle hot water because its melting point is 270° Farenheit. The material also has excellent bonding qualities with other copolymers and is FDA compliant. The polyethylene part number appropriate for the framework 86 is HD-6706 from ExxonMobil Chemical Company, P.O. Box 3272, Houston, Tex. 77253-3272.

The framework 86 suitably may have a connecting Belvedere bridge 88 which spans across the anterior portion of the labial wall 72. The bridge 88 then connects to Cross-cantilever connectors 90 which connect to the occlusal pad plates or wedges 92 in various places to assure the relative stability of the framework 86. The occlusal pad plates 92 shown in FIG. 3 are shown to be thicker posteriorly than anteriorly. The pad plates or wedges 93 in FIG. 4 are shown to be thicker anteriorly than posteriorly. The particular choice of plates or wedges 92 or 93 are dependent upon the physiology of the wearer of the mouthguard 70 suitably determined by medical assistance. The plates or wedges 92 have index openings 94 therethrough.

The next injection molding shot is that of traction pads 114, internal protective bumper 122, protruding tab 124, and external protective bumper 126. The traction pads 114 contact and grip the occlusal biting surfaces 49 of the posterior teeth 48 of the lower jaw and must be composed of a durable, resilient material which deforms somewhat when the jaws are closed and cushion teeth 48 of the lower jaw 42.

The durable resilient material of this layer or second shot comprises a thermoplastic elastomer. The material may be Dynaflex®, Part No. G2780-0001 from GLS Corporation, 833 Ridgeview Drive, McHenry, Ill. 60050. This material is suitable in that the teeth can interdigitate on the pads 114 and the material is chemically and bondably compatible, as well as being FDA compliant and approved for mouthguards.

The traction pads 114 have projecting interlocking knob or projections 116 which resemble a Christmas tree. The bucket lip or retaining lid 120 and interlocking knobs 116 assure that the pads 114 are interlocked with the bite plate wedges 92. Forward of the traction pads 114 extend an anterior impact brace or internal protective elastomeric bumper 122 from which extends protruding tab 124 in an anterior fashion. A transverse external protective elastomeric bumper 126 is connected to tab 124 as they are all integrally molded.

Connectors for the tethers may be left port 128 or right port 130. Because the tether is meant to be securely and permanently fastened, nylon inserts 132 with an annular locking rib 134 are placed in the mold for their interlocking position within the external protective bumper 126 shown in detailed cross section in FIG. 7. The external bumper 126 also suitably supports an artistic logo 135. The nylon material suitably may be part number N6650L from Michael Day Enterprises, 960 Seville Road, Wadsworth, Ohio 44281. The nylon material does not begin to melt until approximately 500° Farenheit.

The durable resilient material of the traction pads 114 and bumpers 122 and 126 may include in another embodiment a styrene block copolymer and ethylene vinyl acetate (EVA). EVA is available from a number of sources, such as ELVAX® Resins from Dupont Packaging and Industrial Polymers, 1007 Market Street, Wilmington, Del. 19398. It is desirable that the durable resilient material have a Shore "A" hardness of approximately 82, which is very durable, yet rubbery.

In another embodiment, the traction pads may have the styrene block copolymer mixed with polyolefin elastomer, which is a copolymer of ethylene and octene-1. A suitable copolymer is available under the trademark ENGAGE® from Dupont Canada, Inc., P.O. Box 2200, Streetsville, Mississauga, Ontario L5M 2H3.

Another embodiment of the pads and bumpers may be a mixture of thermoplastic rubber and a polyolefin elastomer as described above. Suitably thermoplastic rubbers are SANTOPRENE® from Advanced Elastomer Systems, L.P., 388 South Main Street, Akron, Ohio 44311 and KRATON® thermoplastic rubber from Shell Oil Company, Houston, Tex. KRATON® is composed of a styrene-ethylene-butylene-styrene block copolymer and other ingredients. The exact composition of SANTOPRENE® is a trade secret.

The third shot of the mouthguard 70 comprises an encapsulation material 136 which is suitably softenable and forms the walls 70 and 74 and channel 78, as well as base 76 of the mouthguard 70. Thus, the softenable material does not encapsulate the traction pads 114 or bumpers 122 and 126, but does encapsulate the entire framework 86.

The softenable outer fitting material 136 suitably comprises a mixture of EXACT®, which is a plastomer, Part No. 4023 from ExxonMobil Chemical Company, P.O. Box 3272, Houston, Tex. 77253-3272. The EXACT® material is suitably blended 3:1 with a hydrocarbon resin called REGALREZ®, Part No. 1128 from Eastman Chemical Company, 200 South Wilcox, Kingsport, Tenn. 37660. These materials exhibit low melting points, good density and chemically and bondably compatible with other materials, as well as being FDA compliant for mouthguards.

Another combination of the softenable material 136 suitably comprises a mixture of EVA and polycaprolactone. A suitable polycaprolactone is TONE®, Part No. Polymer P-767 from Union Carbide Corporation, 39 Old Ridgebury Road, Danbury, Conn. 06817-0001. The softenable material may consist of polycaprolactone alone as the possibility of ethylene vinyl acetate alone may be utilized.

Another embodiment of the softenable outer material 136 may be a mixture of polycaprolactone and polyolefin elastomer. Preferably, the polyolefin elastomer is a copolymer of ethylene and octene-1. A suitable copolymer is available as ENGAGE® from Dupont Canada, Inc., P.O. Box 2200, Streetsville, Mississauga, Ontario L5M 2H3.

It is well known that illnesses, infection, tooth decay and/or periodontal disease is caused by bacteria, fungus, yeast and viruses. These microbials can grow and multiply on dental appliances when the appliances are being stored between uses, as well as when the appliance is being worn or used. An antimicrobial substance such as ANGION® from Angion Technologies LLC, 60 Autobon Road, Wakefield, Mass. 01880 may be blended with the framework 86, traction pads 114 and bumpers 122 and 126, along with the softenable material 136. Other antimicrobial substances which are non-toxic and free of heavy metal for resisting the growth of microbials may include chlorinated phenol (e.g. 5-CHLORO-2-(2,-4-DICHLOROPHENOXY)PHENOL), POLYHEXAMETHYLENE BIGUANIDE HYDROCHLORIDE (PHMB), DOXYCYCLINE, HLORHEXIDINE, METRONIDAZOLE, THYMOL, EUCALYPOL and METHYL SALYCILATE. TRICLOSAN® from Siba Giegy of Switzerland is also available.

Mouthguard 70 incorporating the antimicrobial agent during the manufacture of the mouthguard is achieved by incorporating the agent into the synthetic polymer master batch. The antimicrobial agent is suitably placed into the batch in a concentration as high as 10% which will permit a let-down ratio resulting in final concentration of the antimicrobial agent and the dental appliance of about 0.005 to about 2% by weight. The antimicrobial agent will survive molten temperatures of approximately 350° Farenheit and thus the antimicrobial agent loses none of its biocidal properties in the formation of the mouthguard.

To fit the mouthguard 70 to the user's mouth, the mouthguard is placed in hot water at 211° Farenheit (i.e. water that has been brought to a boil and taken off the heat) for about fifteen seconds. The mouthguard is then removed from hot water, and it will be very soft, but the framework 86 will hold the mouthguard in its general shape. Excess water is allowed to drain off the mouthguard 70 by holding it with a spoon or a fitting tool.

Next, the wearer carefully places the mouthguard in the mouth so that the interior portion of the appliance 70 touches and covers the eye teeth and extends backwards towards the molars. Next, the wearer bites down firmly on the appliance and pushes the tongue against the roof of the mouth. The Cross-cantilever connectors guide the upper molars 22 in position on plates 92. With a strong sucking motion, the wearer draws out all of the air and water from the mouthguard 70. The projections or knobs 116 of the traction pads 114 will index to the cusps 26 of the molars 22.

With the thumb, the wearer presses the bridge 88 and lingual wall 74 tight against the mouth and then uses his hands and figures to press the outside of the cheeks against the appliance as the labial wall 72 moves to custom form the lingual and buccal or labial walls 72 and 74, respectively. Because there are no rigid lingual or labial walls in the appliance 70, the mouthguard 70 will fit any width of molar 22 or mouth.

The wearer retains the mouthguard in the mouth for at least one minute and, with the mouthguard still in the mouth, takes a drink of cold water. Next, the wearer removes the mouthguard from the mouth and places it in cold water for about thirty seconds.

Figure 7:
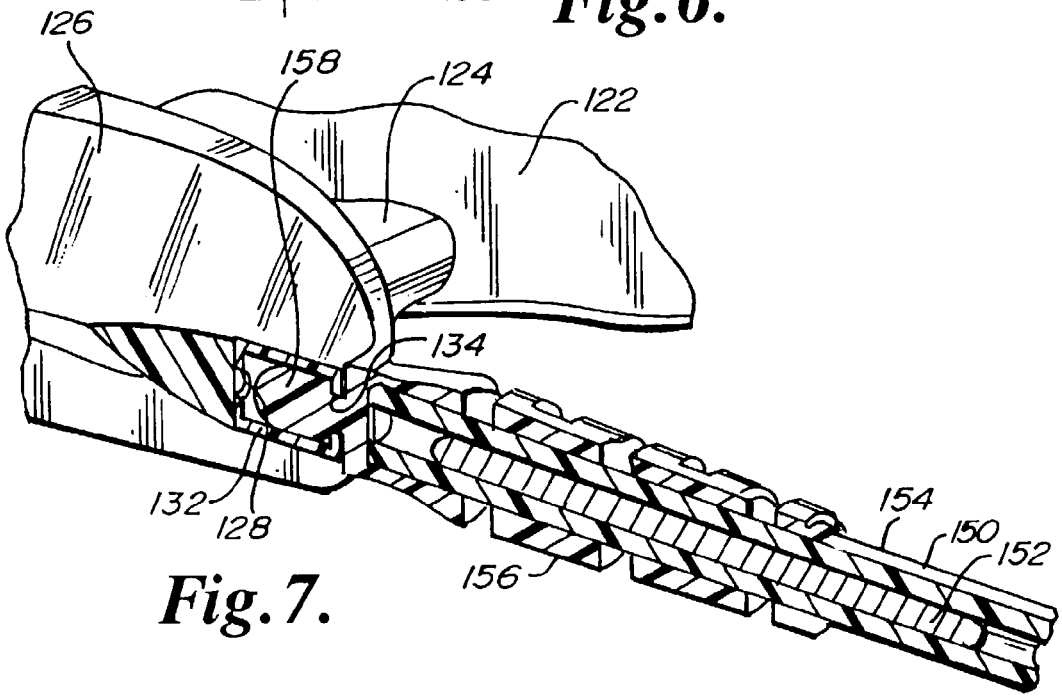
FIG. 7 is an enlarged partially broken away view of the tethered mouthguard with the tether connected taken along lines 6-6 of FIG. 6.

Next, referring to the tether 150 and anchor various arrangements, FIGS. 5 through 13 should be considered. Tether 150 suitably may include an internal wire 152 with a plastic 154 outer casing. The ends of the tether 150 may have over-molded connectors 156 with a locking plug 158 and a lip 160 suitably of a Christmas tree design. The locking plug 158 will almost permanently lock with the nylon insert 132 and its locking rib 134, as shown in FIG. 7. Attempts to remove the tether from either the left or right ports 128 or 130 will likely result in some destruction of the tether or external protective bumper 126. The over-molded connector 156 suitably may be made of a thermoplastic polyurethane elastomer (polyether) marketed under the name PELLETHANE®, Part No. 2363-55D, by Ashland Distribution Company, 5200 Blazer Parkway, Dublin, Ohio 43017. This material must be rigid and durable to secure to connection ports 128 and 130 in a permanent fashion once the user determines whether tethering should be on the left or right side of mouthguard 70.

Figure 8:
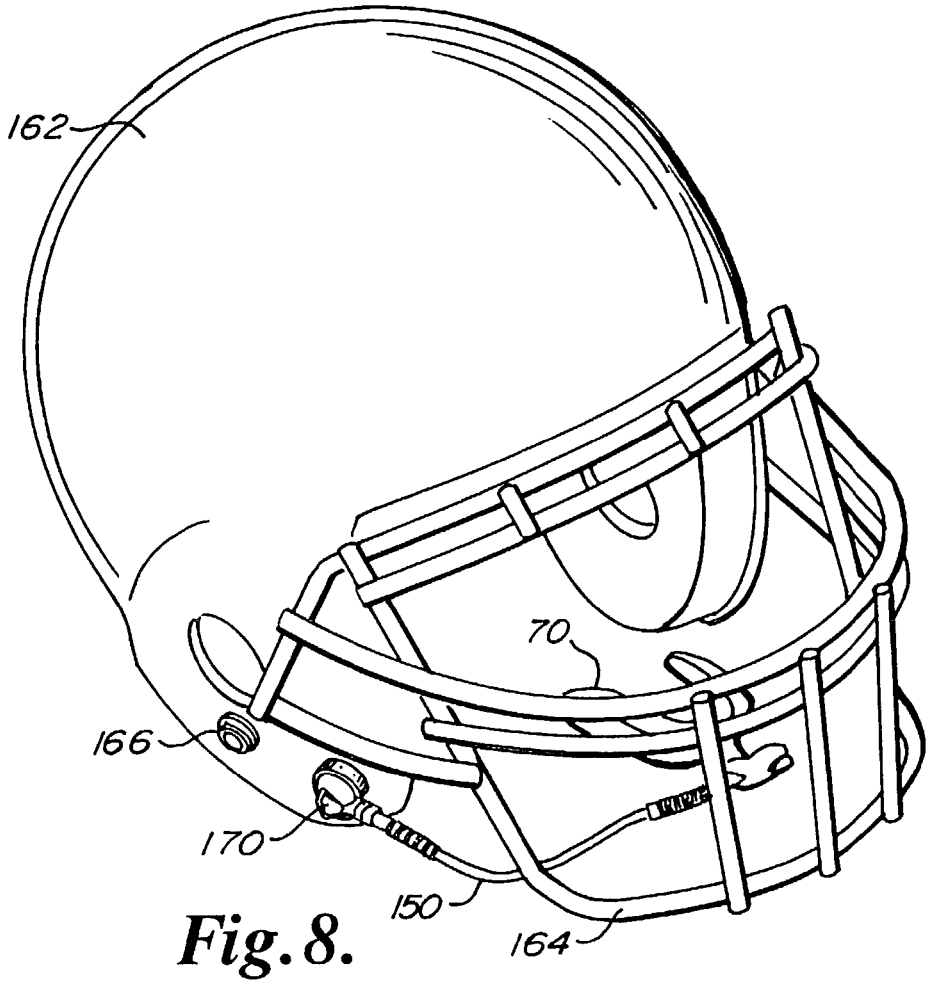
FIG. 8 is an environmental view of the tethered mouthguard wherein the tether is anchored to a chin strap buckle snap.
Figure 9:
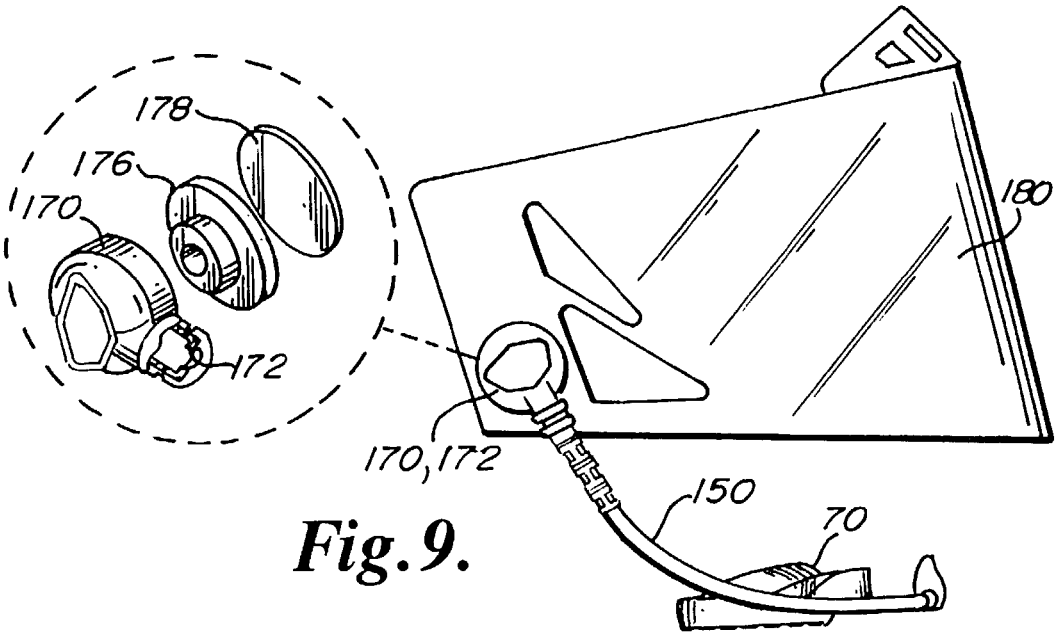
FIG. 9 is a side elevational view of the tethered mouthguard secured to a face screen or shield of a helmet by adhesive particularly shown in explosion within the phantom circle.

Football helmet 162 is shown in FIG. 8 having a face mask 164 and chin strap catches, fasteners or male snap connectors or buckles 166. Face mask tether snap anchor 170 suitably secures to the buckle snaps 166 and has a port 172 with an internal annular locking rib 174.

The catch or buckle snap 176 may be utilized for helmets that do not have buckles 166 therein, such as a hockey helmet face shield 180. Catch 176 is secured to the face shield 180 with double-sided adhesive tape 178 shown in FIG. 9.

Figure 10:
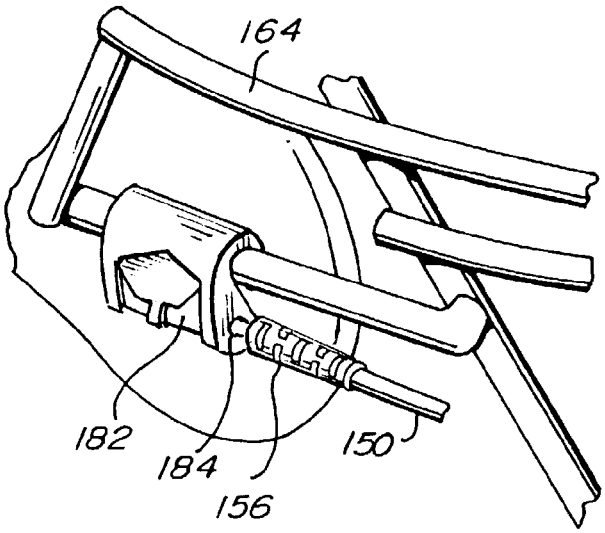
FIG. 10 shows the face mask tether clamp anchor fastened to a face mask of a football helmet.
Figure 11:
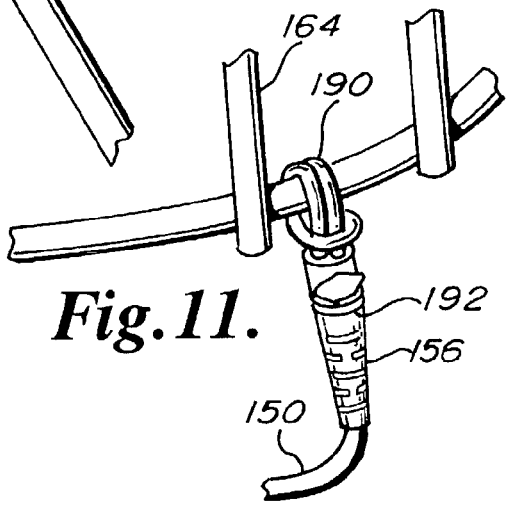
FIG. 11 shows the face mask tether cinch anchor connected to a face mask of a football helmet.

In another embodiment, face mask tether clamp anchor 182 is shown in FIG. 10 suitably having a port 184 with an annular locking rib internally to receive the over-molded connectors 156 of tether 150. Face mask tether cinch anchor 190 is another variation shown in FIG. 11 having a port 192 with an internal annular locking rib. Anchors 170, 182 and 190 are suitably made of thermoplastic resin or ethylene/methacrylic acid copolymer such as SURLYN® 8150 from Dupont.

Figure 12:
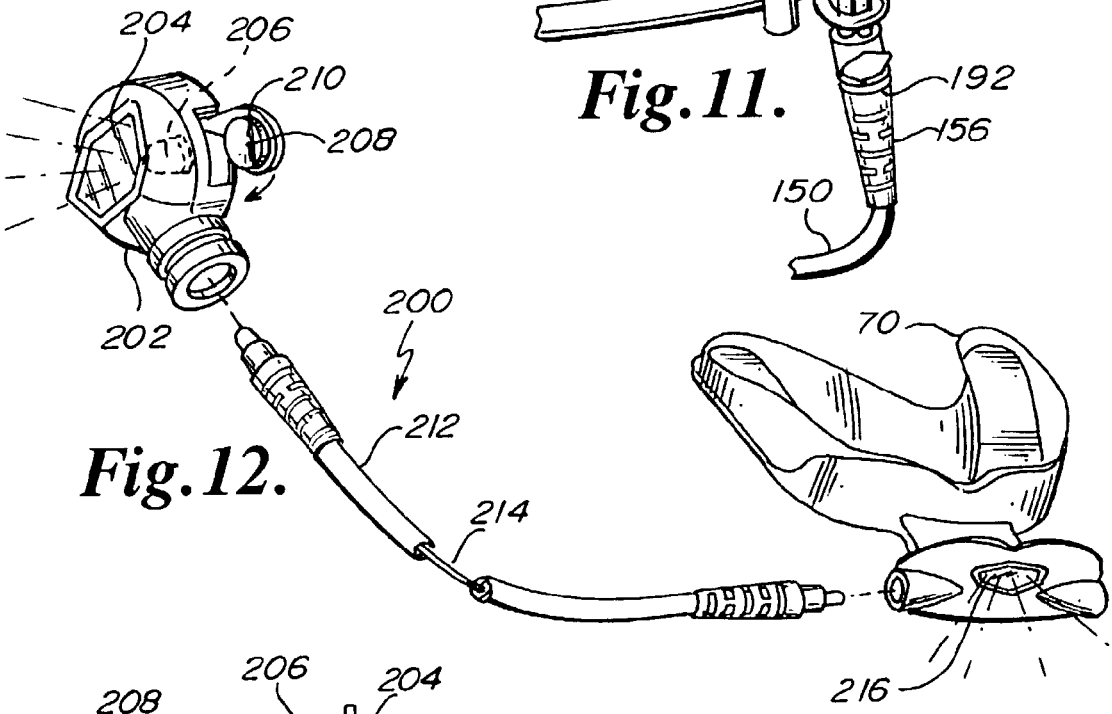
FIG. 12 shows a perspective view of the illuminated mouthguard tether and anchor.
Figure 13:
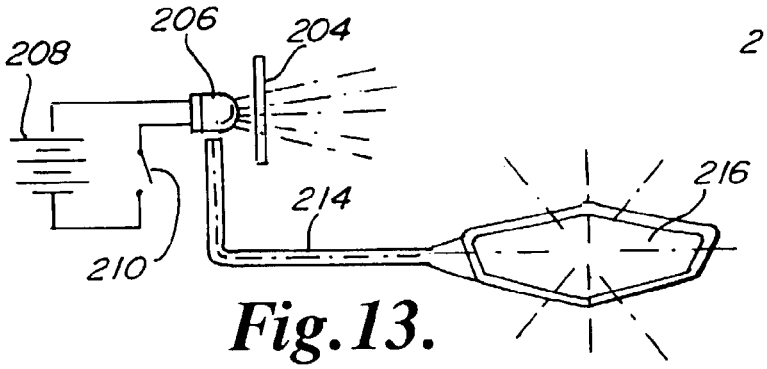
FIG. 13 shows the schematics of the illumination of FIG. 12.

Referring to FIGS. 12 and 13, the lighted mouthguard tether and anchor assembly 200 is shown. The face mask tether snap anchor 202 has a logo lens 204 therein with a light 206 or suitably an LED there below. A battery 208 sits within door switch 210 much like a hearing aid. Upon closing the door switch 210, the circuit is closed and the LED lights the logo lens 204. Tether 212 may have internal fiberoptics 214 which will carry the light to the mouthguard logo lens 216 in the external bumper 126.

The present invention may be embodied in other specific forms without departing from the spirit or central attributes thereof; therefore, the illustrated embodiments should be considered in all respects as illustrative and not restrictive, reference being made to the appended claims rather than to the foregoing description to indicate the scope of the invention.

The invention claimed is:

1. A tethered mouthguard, comprising (a) a u-shaped base with upstanding labial and lingual walls forming a channel;

(b) a protruding tab extending from an anterior portion of the labial wall; and (c) a transverse external bumper fixedly connected to the tab having left and right side connectors are attached transverse to the external bumper for securing a tether to one of the left or right connector of the bumper; and (d) wherein the left and right side connectors are interlocking ports for securing the tether, wherein the tether is secured to one of the left or right connector, the transverse external bumper extends upward in the same direction as the labial wall to form a channel between the labial wall and transverse external bumper to receive an upper lip of a user.

2. The tethered mouthguard of claim 1, further comprising a remote anchor on a helmet for releasable securing the tether.

3. The tethered mouthguard of claim 2, wherein the remote anchor comprises a snap buckle securable to the helmet with adhesive.

4. The tethered mouthguard of claim 3, wherein the snap buckle is securable to a face shield on the helmet.

5. The tethered mouthguard of claim 2, wherein the remote anchor comprises a clamp securable to a face mask on the helmet.

6. The tethered mouthguard of claim 2, wherein the anchor, tether or mouthguard are illuminated.

7. The tethered mouthguard of claim 2, wherein the remote anchor comprises a snap securable to a snap buckle on the helmet.

8. The tethered mouthguard of claim 1, wherein the external bumper supports a visual artistic logo.

9. A tethered mouthguard, comprising:

a u-shaped base with upstanding labial and lingual walls forming a channel;

a protruding tab attached to an anterior portion of the labial wall;

a transverse surface fixedly connected to the tab, the transverse surface transverse with respect to the tab, at least a portion of the transverse surface spaced away from the labial wall;

a connector attached to the transverse surface for securing a tether to the transverse surface;

a tether further comprising a first end for connecting to the connector, and wherein the connector and the first end of the tether include an axis transverse to the protruding tab when the first end is connected to the connector; and a locking portion associated with at least one of the connector and the first end of the tether for locking the connector and the first end of the tether.

10. The tethered mouthguard of claim 9, wherein the tether further comprises a second end further including an attachment apparatus for attaching the second end to a surface remote from the transverse surface of the mouthgaurd.

11. The tethered mouthguard of claim 10, wherein the second end of the tether is different from the first end of the tether.

12. The tethered mouthguard of claim 11 further comprising a snap portion attached to the second end of the tether.

13. The tethered mouthguard of claim 11 further comprising an adhesive portion attached to the second end of the tether.

14. The tethered mouthguard of claim 9, wherein the transverse surface and the labial wall to form a channel for receiving an upper lip of a user.

15. The tethered mouthguard of claim 10, wherein the surface remote from the transverse surface of the mouthgaurd is a surface on a helmet.

16. The tethered mouthguard of claim 10, wherein the surface remote from the transverse surface of the mouthgaurd is a surface on a face mask.

17. The tethered mouthguard of claim 9, wherein the locking portion associated with at least one of the connector and the first end of the tether for substantially permanently locks the connector and the first end of the tether.

18. A mouthguard, comprising a u-shaped base with upstanding labial and lingual walls forming a first channel;

a protruding tab fixedly attached to the labial wall;

an external bumper fixedly connected to the tab, the external bumper transverse to the tab and spaced from the labial wall to form a second channel between the labial wall and the external bumper;

a connector attached to the external bumper, the connector axis is substantially transverse to the tab, the connector including a locking rib; and a tether attached to the connector.

19. The mouthguard of claim 18, further comprising:

a source of light;

a logo positioned at a visible location on the external bumper, wherein the light source illuminates the logo.

20. The mouthguard of claim 19, wherein the light source is remote from the mouthguard, the tether further comprising fiber optic cable for delivering light from the remote source to the logo.

21. The mouthguard of claim 18, wherein the tether further comprises:

a first end for connecting to the connector attached to the external bumper; and a second end having an attachment apparatus for attaching to a surface remote from the mouthguard.

22. The mouthguard of claim 18, wherein the attachment apparatus includes an adhesive for adhering to the remote surface.

23. The mouthguard of claim 18, wherein the attachment apparatus includes a portion of a snap.

24. The mouthguard of claim 18, wherein the connector and first end of the tether form a substantially permanent connection.

25. The mouthguard of claim 18 further comprising a second connector which is sub stantially collinear with the first connector, the first end of the tether capable of being connected to one of the first connector or the second connector.

26. The mouthguard of claim 18, wherein the tether further includes a cable.

27. The mouthguard of claim 18, wherein the tether further includes a fiber optic cable.

* * * * *